US007465197B1

(12) United States Patent
Wu et al.

(10) Patent No.: US 7,465,197 B1
(45) Date of Patent: Dec. 16, 2008

(54) MULTI-IN-ONE CARD CONNECTOR THAT ALLOWS INSERTION OF ONLY ONE SINGLE CARD AT A TIME

(75) Inventors: Wen-Han Wu, Taipei County (TW); Chin-Hwa Wu, Taoyuan County (TW)

(73) Assignee: Tai-Sol Electronics Co., Ltd., Taipei (TW)

( * ) Notice: Subject to any disclaimer, the term of this patent is extended or adjusted under 35 U.S.C. 154(b) by 0 days.

(21) Appl. No.: 12/073,093

(22) Filed: Feb. 29, 2008

(30) Foreign Application Priority Data

Sep. 7, 2007 (TW) ..... 96133534 A

(51) Int. Cl.
*H01R 24/00* (2006.01)

(52) U.S. Cl. ..... 439/630; 439/136

(58) Field of Classification Search ..... 439/136–140, 439/160, 377, 630–635
See application file for complete search history.

(56) References Cited

U.S. PATENT DOCUMENTS 6,120,322 A * 9/2000 Ho et al. ..... 439/541.5
6,908,321 B1 * 6/2005 Lai ..... 439/140
7,108,558 B2 * 9/2006 Zhu et al. ..... 439/630
7,112,095 B2 * 9/2006 Shen et al. ..... 439/630
7,303,413 B1 * 12/2007 Lai et al. ..... 439/152
7,377,814 B2 * 5/2008 Shen et al. ..... 439/630
2008/0132110 A1 * 6/2008 Lai et al. ..... 439/489

* cited by examiner

*Primary Examiner*—James Harvey
(74) *Attorney, Agent, or Firm*—Bacon & Thomas, PLLC

(57) ABSTRACT

A low profile design of multi-in-one card connector includes a base frame having two upright sidewalls and a guide groove at the front side of each upright sidewall and defining a front insertion opening, multiple terminal sets mounted in the base frame, two limiter blocks vertically movably mounted in the guide grooves of the upright sidewalls each having a top stop flange and a bottom stop flange, at least one of the top and bottom stop flanges of each limiter block being held in the front insertion opening to prohibit insertion of a second memory card after insertion of a first memory card, and two elastic members supporting the limiter blocks in an upper limit position.

10 Claims, 10 Drawing Sheets

MULTI-IN-ONE CARD CONNECTOR THAT ALLOWS INSERTION OF ONLY ONE SINGLE CARD AT A TIME

BACKGROUND OF THE INVENTION

1. Field of the Invention

The present invention relates to electrical connection devices and more particularly, to a multi-in-one card connector that allows insertion of only one single card member.

2. Description of the Related Art

Various multi-in-one card connectors have been disclosed for use with a card reader to fit different card members. In order to prevent a reading error due to insertion of multiple cards at a time, multi-in-one card connectors that allow insertion of only one card member are created.

U.S. Pat. No. 6,908,321 discloses a card connector entitled All-in-one card connector that is comprised of a base frame, two plate-like members, and a plurality of terminals. The base frame has an opening formed at a front end thereof, two lateral sections formed respectively at bilateral sides of the opening, a concavity formed at one lateral section, a movable guide member mounted in the concavity for upward and downward movement respectively for blocking a large width card and a small width card, and a springy member mounted between the guide member and the base frame for generating resilience keeping movement of the guide member. The base frame is mounted closely between the two plate-like members. Each of the terminals is mounted on the plate-like member and extends into the opening to be electrically connected with contact pads of an inserted electronic card. Accordingly, when an electronic card is inserted into the card connector, the guide member allows the entry of the card to be pushed by the card to move towards a direction to further stop entry of another card.

According to the aforesaid prior art design, the guide member is moved vertically up and down to control insertion of a card member (SD memory card or XD memory card) into the space above or below. Therefore, the guide member requires a big vertical space. This limitation is not in favor of a low profile design.

SUMMARY OF THE INVENTION

The present invention has been accomplished under the circumstances in view. It is one object of the present invention to provide a multi-in-one card connector that has a low profile characteristic and prohibits insertion of a second card member after insertion of one first card member.

To achieve this and other objects of the present invention, the multi-in-one card connector comprises an electrically insulative base frame that has a bottom panel, two upright sidewalls vertically upwardly extending from two opposite lateral sides of the bottom panel and defining with the bottom panel a front insertion opening, and at least one guide groove formed on a front side of at least one of the two upright sidewalls, a plurality of terminal sets respectively mounted inside the base frame at different locations for the contact of different memory cards, at least one limiter block mounted in and vertically movable along the at least one guide groove, each limiter block comprising a top stop flange and a bottom stop flange respectively extending from the top side and bottom side thereof toward the inside of the base frame, at least one of the top stop flange and the bottom stop flange being held in the front insertion opening, and at least one elastic member connected between the base frame and the at least one limiter block to support the at least one limiter block in a predetermined position. By means of the aforesaid arrangement, the multi-in-one card connector has a low profile, and prohibits insertion of a second memory card after insertion of one memory card.

DETAILED DESCRIPTION OF THE INVENTION

Figure 1:
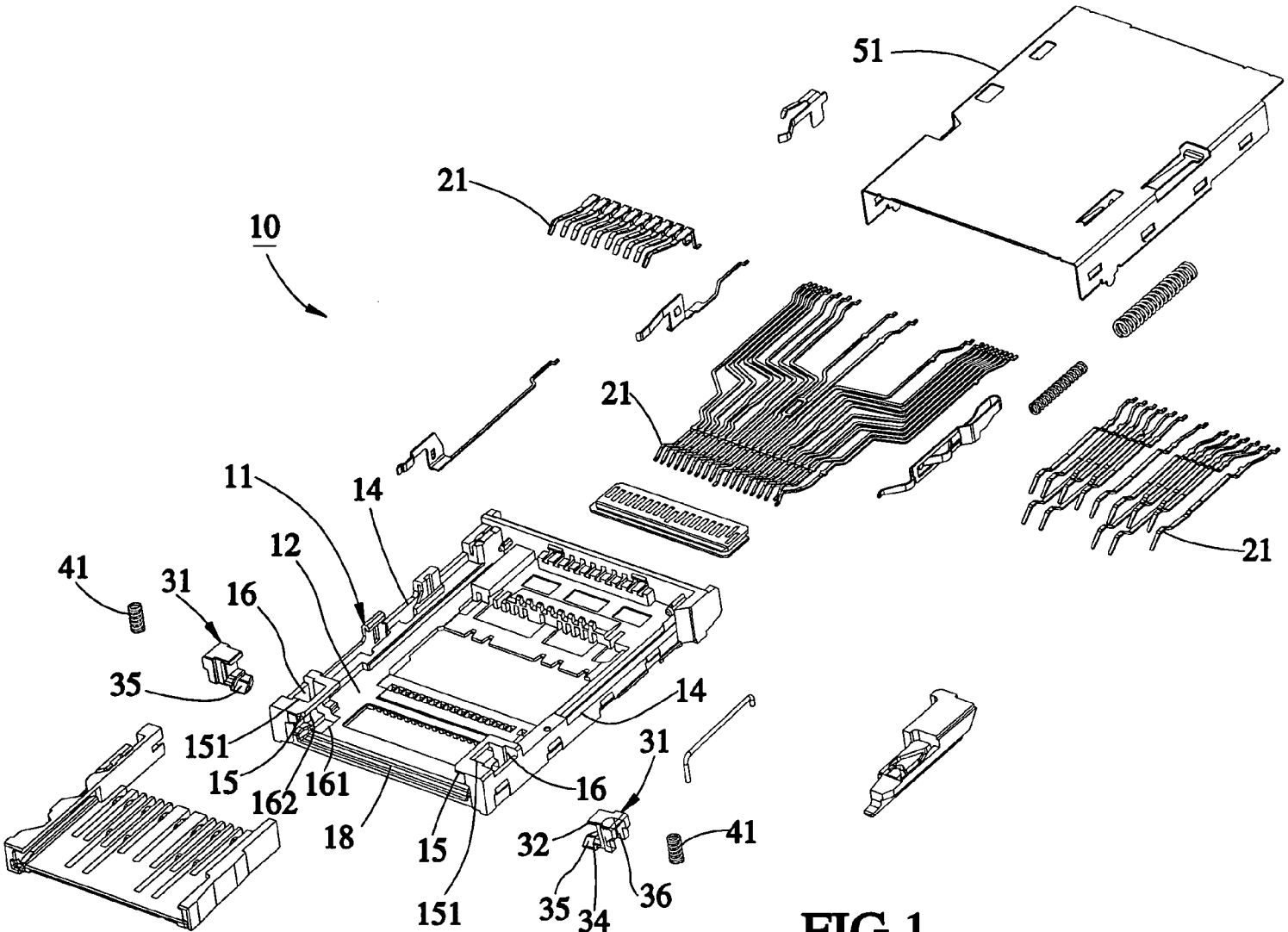
FIG. 1 is an exploded top elevation of a multi-in-one card connector in accordance with the present invention.
Figure 2:
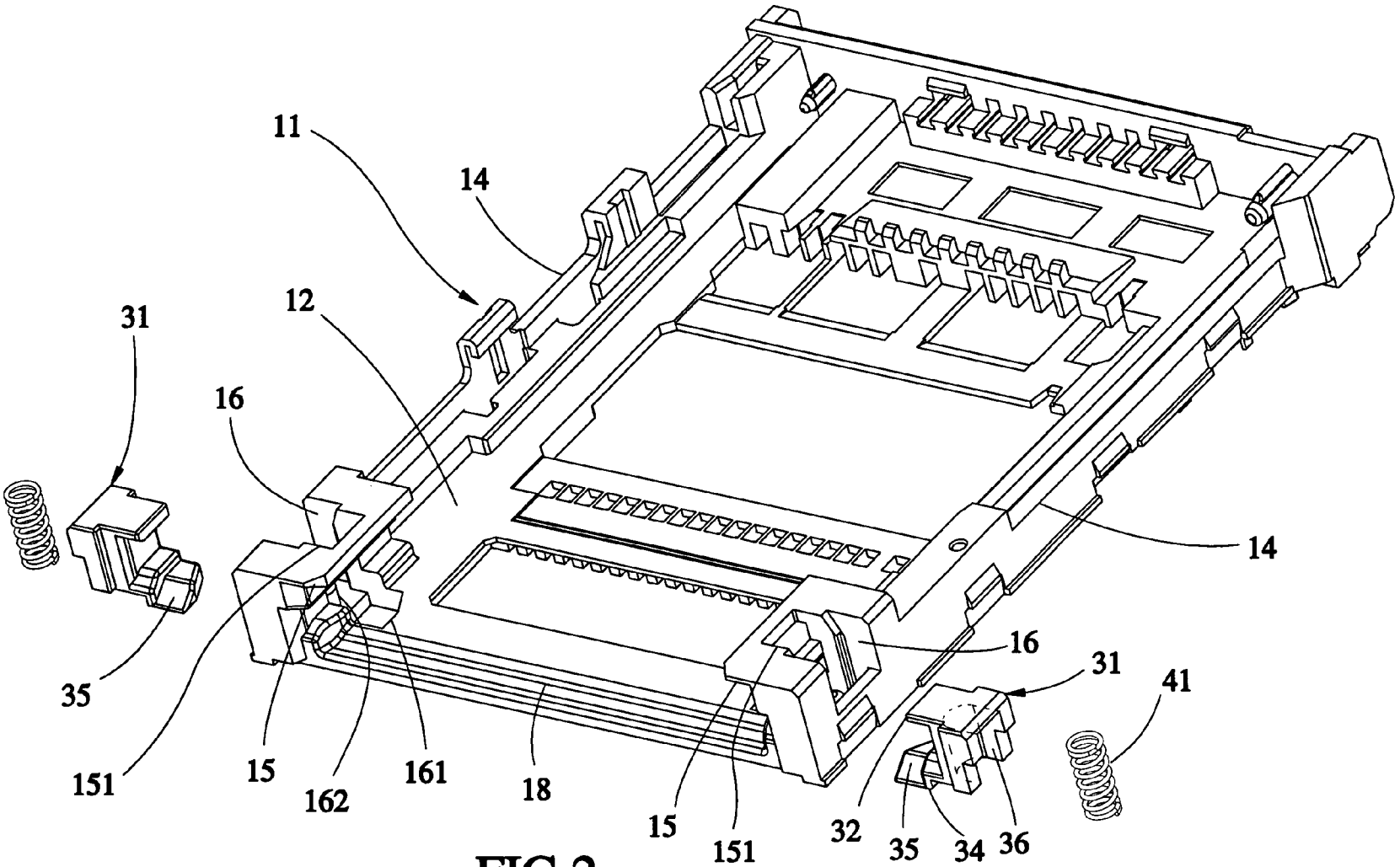
FIG. 2 is an exploded view of a part of the multi-in-one card connector in accordance with the present invention, showing the structure of the base frame and the limiter blocks.
Figure 3:
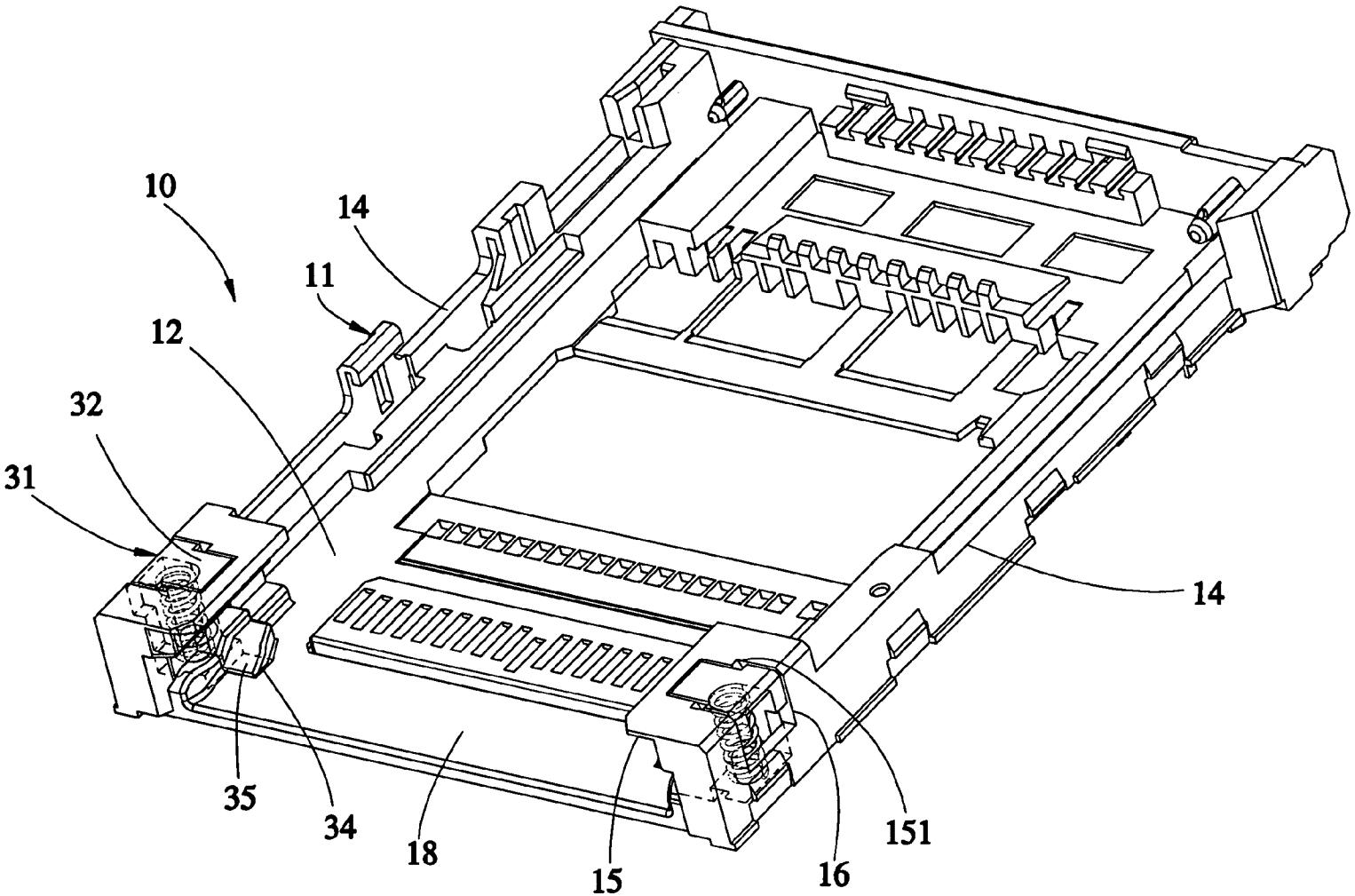
FIG. 3 is a perspective assembly view of FIG. 2.
Figure 4:
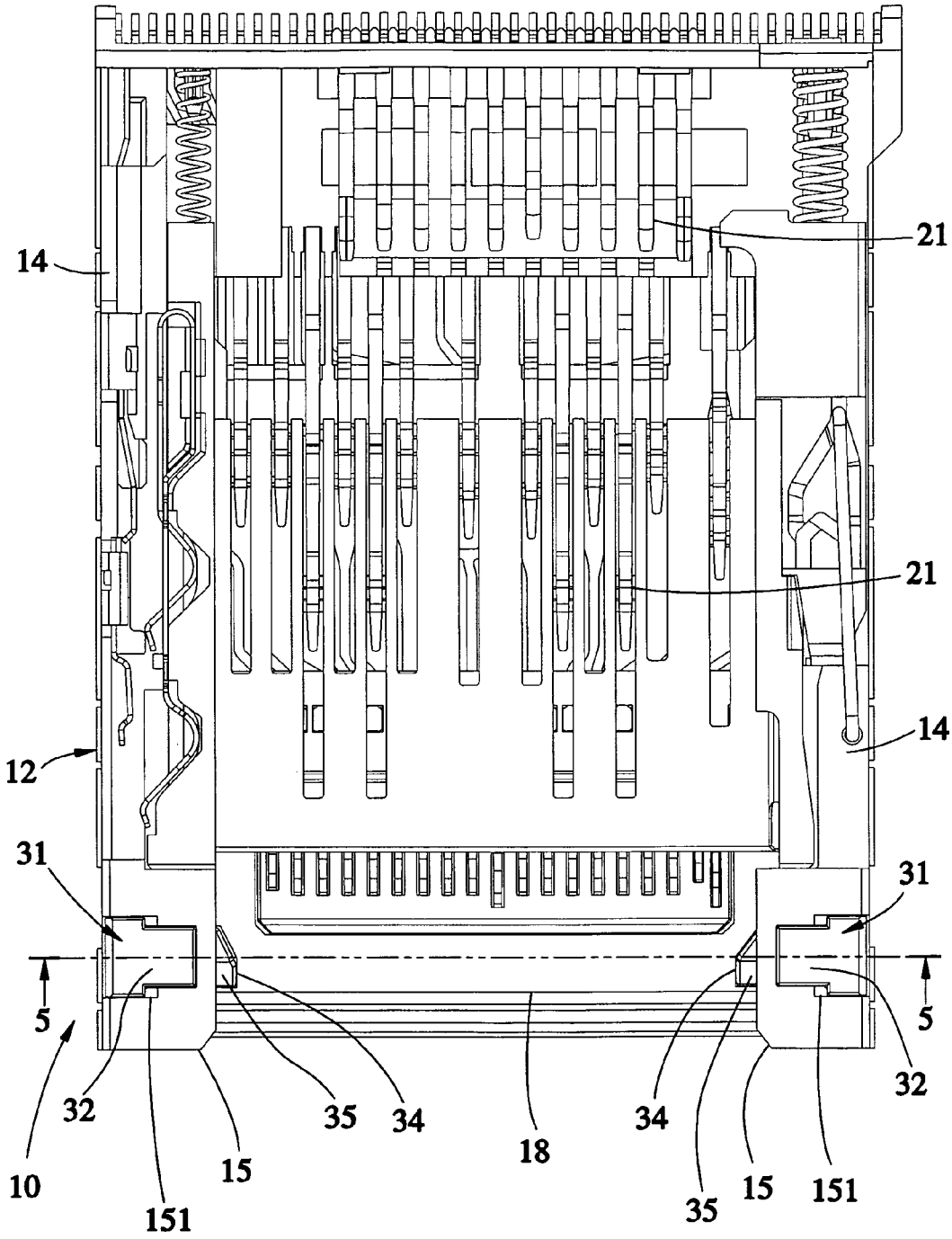
FIG. 4 is a top view of the multi-in-one card connector in accordance with the present invention after removal of the top cover.

Referring to FIGS. 1~5, a multi-in-one card connector 10 in accordance with the present invention is shown comprised of a base frame 11, multiple terminal sets 21, two vertically movable limiter blocks 31, two elastic members 41, and a top cover 51.

The base frame 11 is an electrically insulative member having a bottom panel 12, two upright sidewalls 14 perpendicularly upwardly extending from the bottom panel 12 at two opposite lateral sides, two vertical sliding grooves 16 respectively formed on the upright sidewalls 14 near the front side, and a front insertion opening 18 defined by the bottom panel 12 and the upright sidewalls 14 through which a memory card is insertable into the multi-in-one card connector 10. The upright sidewalls 14 each have a front shoulder 15 suspending above the front insertion opening 18. The front shoulder 15 has a through hole 151 in communication with the associating vertical sliding groove 16. The bottom panel 12 has two locating grooves 161 bilaterally disposed on the top surface adjacent to the vertical sliding grooves 16, and an upright pin 162 in each locating groove 161.

The number of the multiple terminal sets 21 according to the present preferred embodiment is 3. These three terminal sets 21 are respectively installed in the bottom panel 12 at different locations for the contact of a respective memory card (for example, a MS (Memory Stick) memory card, SD (Secure Digital) memory card, or XD (Extreme Digital) memory card).

The two limiter blocks 31 are respectively mounted in and movable along the vertical sliding grooves 16. Further, the limiter blocks 31 have a respective stepped inner lateral side facing each other to fit the side edge configurations of different memory cards. The two limiter blocks 31 each have a top stop flange 32 and a bottom stop flange 34 respectively extending from the top and bottom sides in same direction. At least one of the top stop flange 32 and the bottom stop flange 34 is suspending in the front insertion opening 18. The top flange 32 of each limiter block 31 is inserted through the through hole 151 of the associating front shoulder 15 and constrained by the associating through hole 151. The bottom flange 34 faces one locating groove 161 of the bottom panel 12. When the limiter blocks 31 are lowered, the bottom flanges 34 of the limiter blocks 31 are respectively forced into the locating grooves 161 of the bottom panel 12. The bottom flange 34 of each limiter block 31 has a sloping surface 35 disposed at the front side and facing upwards. Each limiter block 31 further has an accommodation groove 36 at the outer lateral side opposite to the stepped inner lateral side.

The two elastic members 41 according to the present preferred embodiment are compression springs respectively accommodated in the accommodation grooves 36 of the limiter blocks 31 and respectively sleeved onto the upright pins 162 in the locating grooves 161 of the bottom panel 12 and respectively stopped between the bottom panel 12 and the limiter blocks 31.

The top cover 51 is covered on the base frame 11 over the shoulders 15. Subject to the spring force of the elastic members 41, the limiter blocks 31 are stopped at the bottom side of the top cover 51.

The operation of the present invention is outlined hereinafter.

Figure 5:
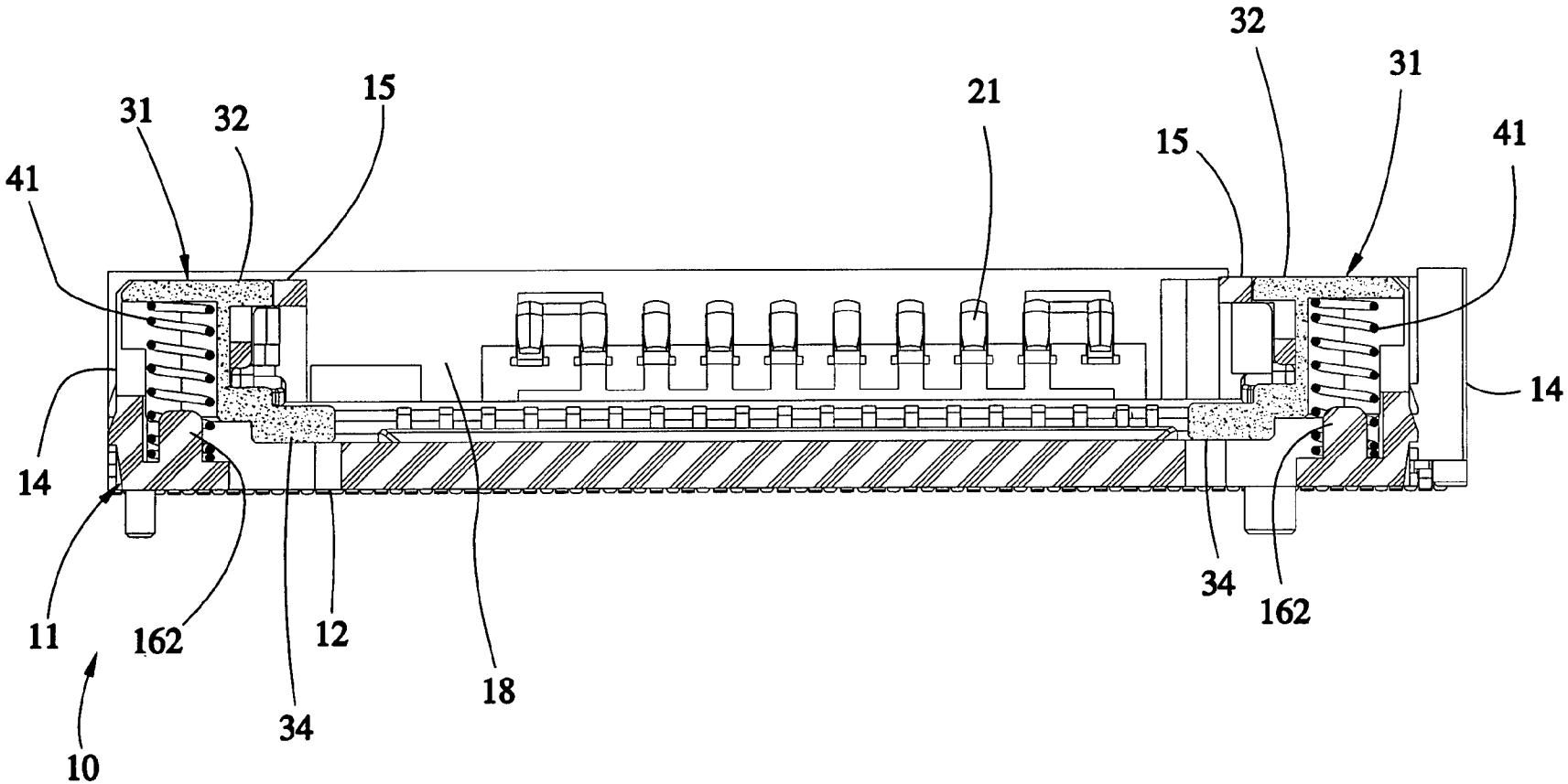
FIG. 5 is a sectional view taken along line 5-5 of FIG. 4.

Referring to FIG. 5, before insertion of a card, the spring force of the two elastic members 51 supports the limiter blocks 31 in the upper limit position. At this time, the bottom stop flanges 34 of the limiter blocks 31 are suspending in the front insertion opening 18 and the top stop flanges 34 of the limiter blocks 31 are in the associating through holes 151 in flush with the associating shoulders 15.

Figure 6:
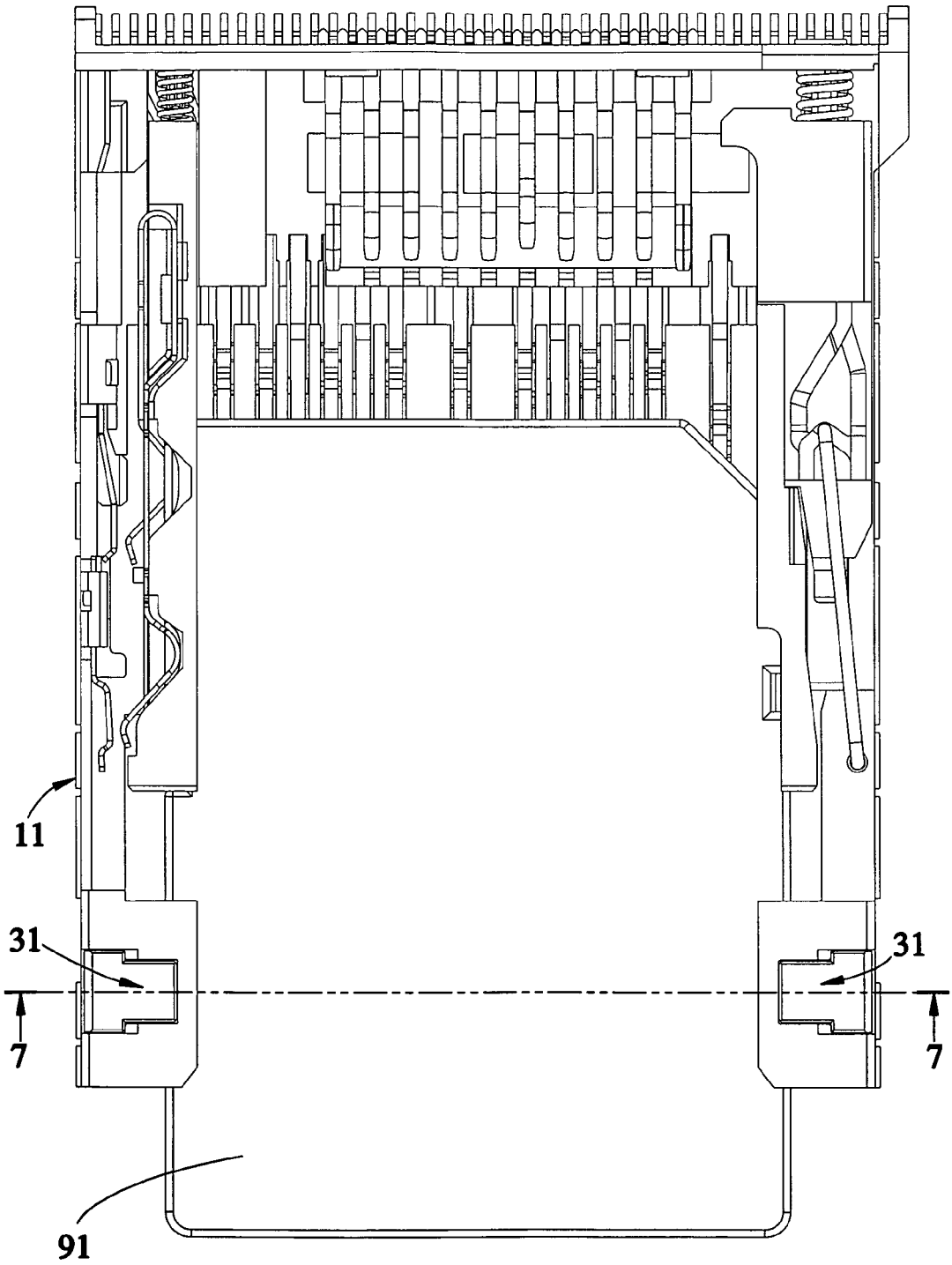
FIG. 6 is a schematic drawing of the present invention, showing a SD memory card inserted into the multi-in-one card connector.
Figure 7:
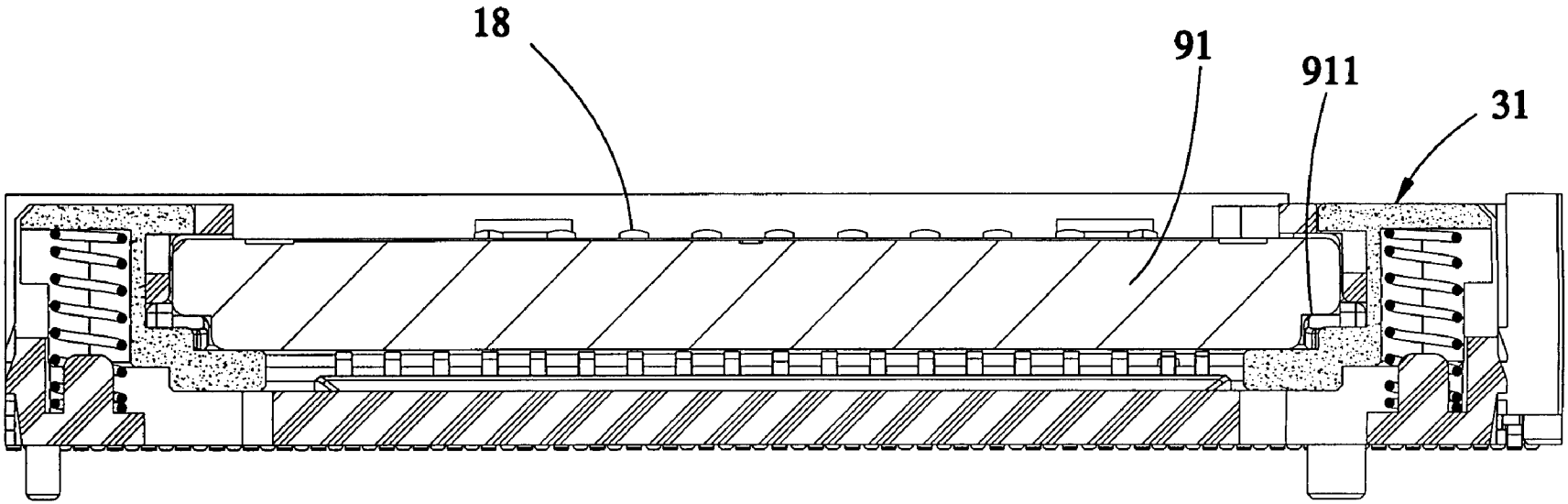
FIG. 7 is a sectional view taken along line 7-7 of FIG. 6.

Referring to FIG. 6 and FIG. 7, when inserting a MS card 91 into the multi-in-one card connector 10, the two opposite stepped side edges 911 of the MS card 91 do not touch the sloping surfaces 35 of the bottom flanges 34 of the limiter blocks 31 (see FIG. 2), and therefore the MS card 91 can be smoothly inserted through the front insertion opening 18 into contact with the corresponding terminal set 21. At this time, the MS card 91 occupies the major part of the cross section of the front insertion opening 18, and therefore there is no room for the insertion of any other memory card.

Figure 8:
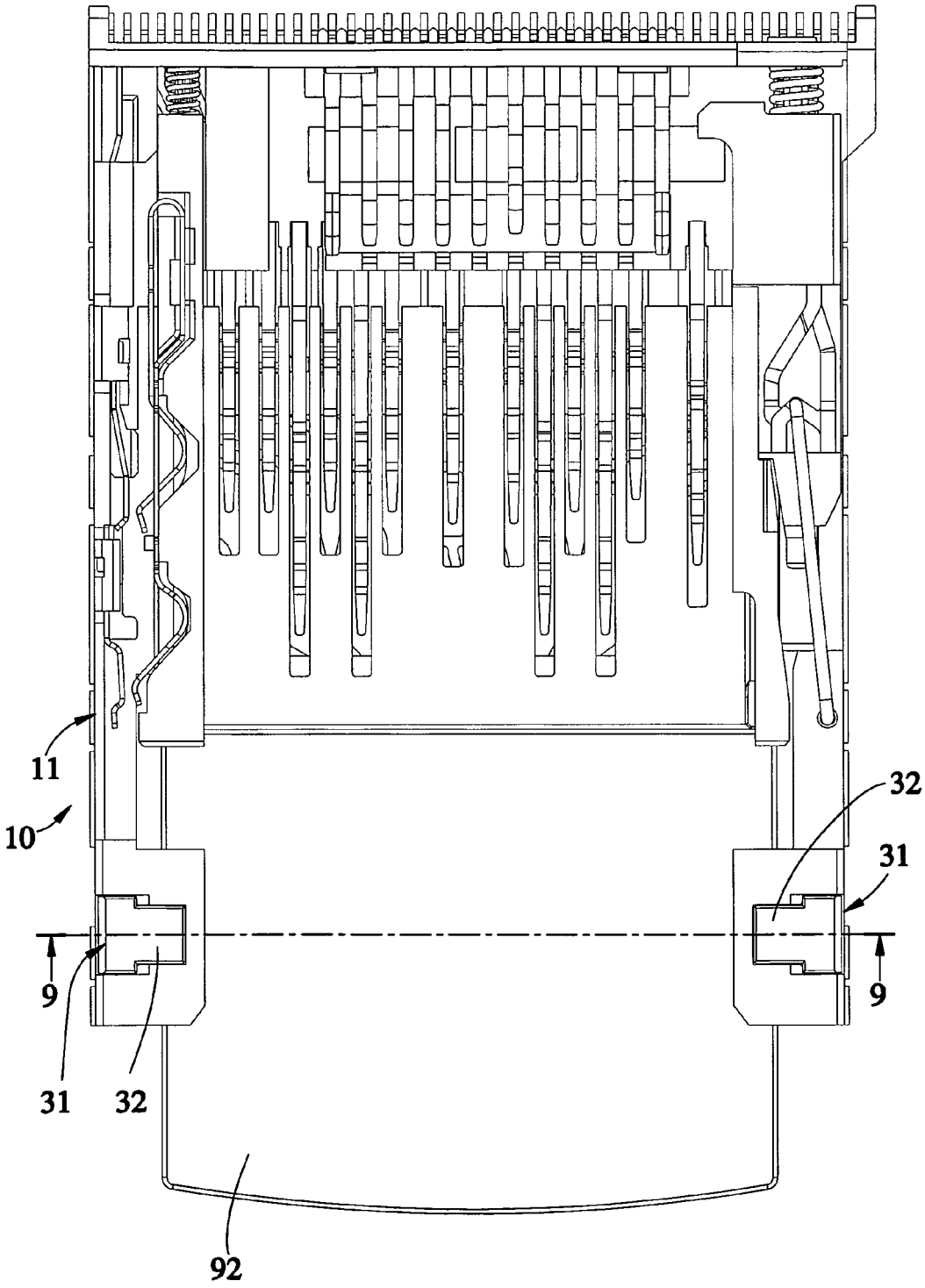
FIG. 8 is a schematic drawing of the present invention, showing a XD memory card inserted into the multi-in-one card connector.
Figure 9:
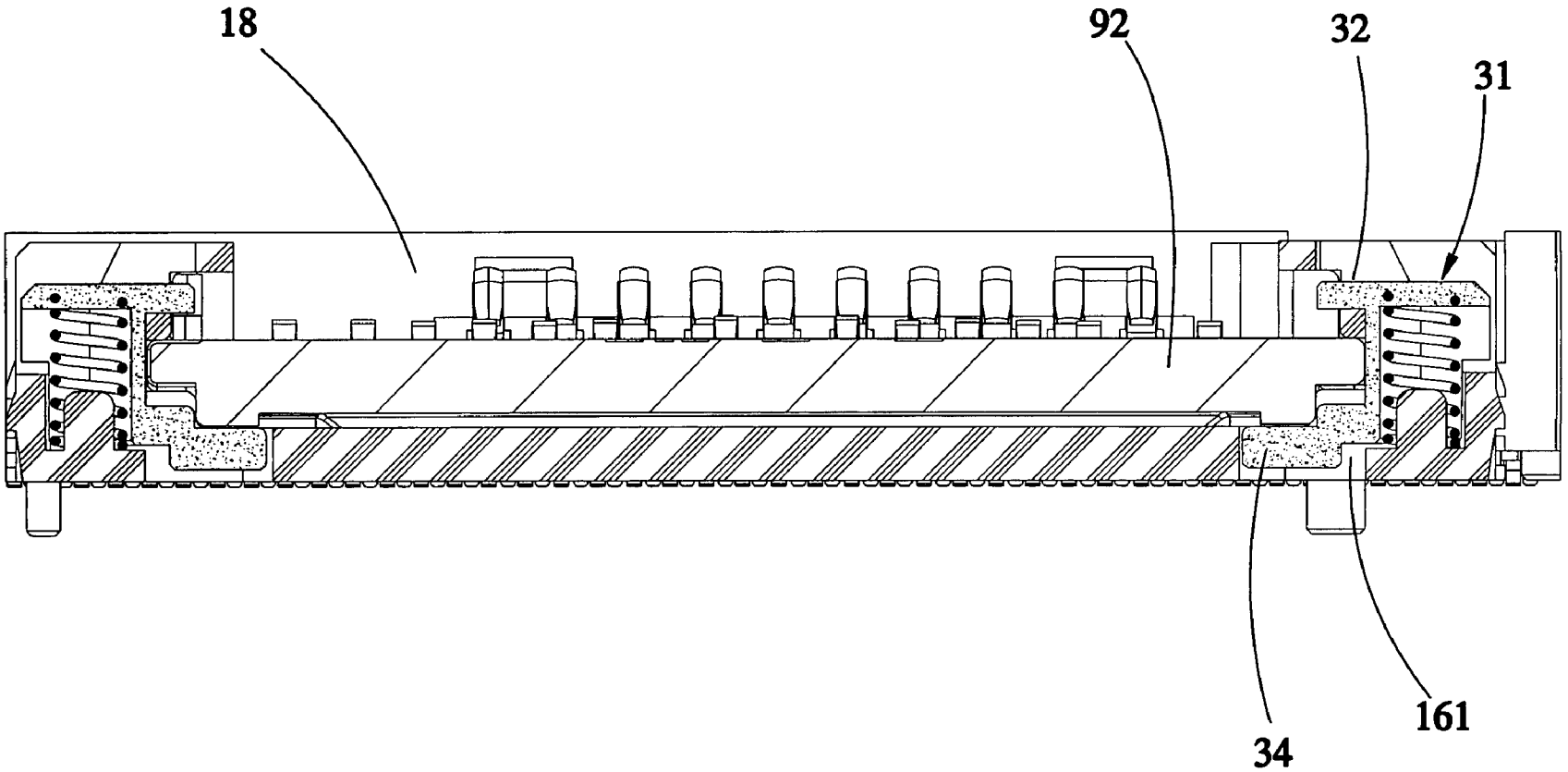
FIG. 9 is a sectional view taken along line 9-9 of FIG. 8.
Figure 10:
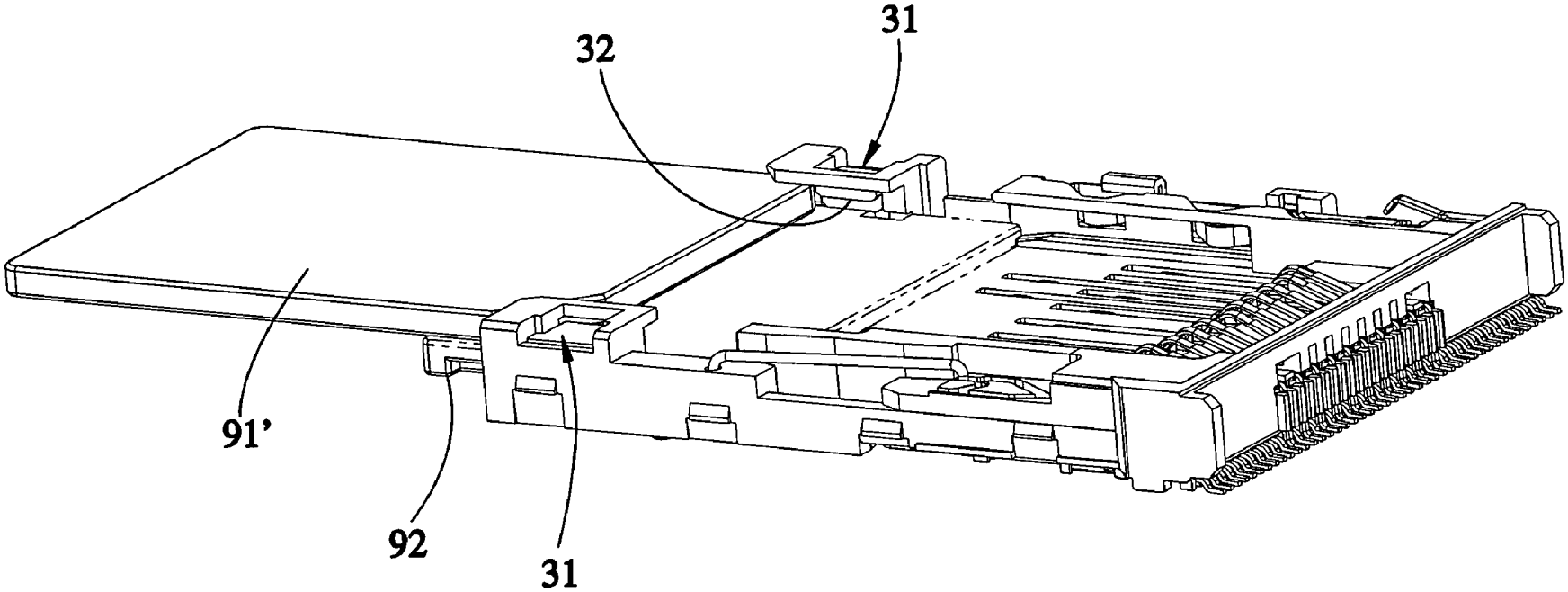
FIG. 10 is a schematic drawing of the present invention, showing a MMC memory card stopped on the outside after insertion of a XD memory card into the multi-in-one card connector.

Referring to FIGS. 8 and 9, when inserting a XD memory card 92 into the multi-in-one card connector 10, the front edge of the XD memory card 92 will touch the sloping surfaces 35 of the bottom stop flanges 34 of the limiter blocks 31 (see FIG. 2) and will further force the bottom stop flanges 34 of the limiter blocks 31 downward to the associating locating grooves 161. When the bottom stop flanges 34 of the limiter blocks 31 are downward to the associating locating grooves 161, the top stop flanges 32 are also lowered into the front insertion opening 18 to prohibit insertion of any other memory card. FIG. 10 illustrates the positioning status of the limiter blocks 31 after the XD memory card 92 has been set into position. When inserting any other memory card, for example, MMC (MultiMediaCard) memory card 91' into the space above the XD (Extreme Digital) memory card 92 at this time, the front edge of the MMC memory card 91' will be stopped by the top stop flanges 32, and therefore the insertion of the MMC memory card 91' is prohibited.

Further, because a MS (Memory Stick) memory card (not shown) is thicker than a SD card 91, when a MS memory card is inserted into the multi-in-one card connector 10, it occupies the whole space of the front insertion opening 18, prohibiting insertion of any other memory card. The insertion status of a MS memory card is similar to the insertion status of a SD card 91, no further description in this regard is necessary.

As stated above, the multi-in-one card connector 10 does not allow insertion of any other memory card after the insertion of a SD memory card 91. When a XD memory card 92 is inserted into the multi-in-one card connector 10, the top stop flanges 32 are lowered with the limiter blocks 31 into the front insertion opening 18 to prohibit insertion of any other memory card (SD memory card 91 or MMC memory card 91').

In conclusion, the invention has the advantages and features as follows:

The invention effectively reduces the vertical height and allows insertion of one single memory card only. When inserting a SD memory card 91 into the multi-in-one card connector 10, the limiter blocks 31 are immovable. The limiter blocks 31 will be moved only when a XD memory card 92 is inserted into the multi-in-one card connector 10. Therefore, designing the space for allowing movement of the limiter blocks 31 needs only to consider the moving range of one kind of memory card. Further, the limiter blocks 31 needs to be lowered through a small distance to prohibit insertion of a SD memory card 91 or MMC memory card 91' after the insertion of a XD memory card 92.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A multi-in-one card connector comprising:

a base frame being electrically insulative, said base frame comprising a bottom panel, two upright sidewalls vertically upwardly extending from two opposite lateral sides of said bottom panel and defining with said bottom panel a front insertion opening, at least one guide groove formed on a front side of at least one of said two upright sidewalls; and a plurality of terminal sets respectively mounted inside said base frame at different locations for the contact of different memory cards;

wherein the multi-in-one card connector further comprises:

at least one limiter block mounted in and vertically movable along said at least one guide groove, said at least one limiter block each comprising a top stop flange and a bottom stop flange respectively extending from a top side and bottom side thereof toward the inside of said base frame, at least one of said top stop flange and said bottom stop flange suspending in said front insertion opening; and at least one elastic member connected between said base frame and said at least one limiter block to support said at least one limiter block in a predetermined position.

2. The multi-in-one card connector as claimed in claim 1, wherein the number of said at least one guide groove is 2, and the two guide grooves are respectively formed on the front side of each of said two upright sidewalls; the number of said at least one limiter block is 2, and the two limiter blocks are respectively accommodated in said two guide grooves; the number of said at least one elastic member is 2, and the two elastic members are respectively mounted in said two guide grooves and respectively connected between said two limiter blocks and said base frame.

3. The multi-in-one card connector as claimed in claim 1, wherein said at least one elastic member supports said at least one limiter block in an upper limit position.

4. The multi-in-one card connector as claimed in claim 3, wherein the bottom stop flange of each of said at least one limiter block has a sloping surface disposed at a front side of the multi-in-one card connector and facing upwards.

5. The multi-in-one card connector as claimed in claim 3, wherein said upright sidewalls each have a shoulder suspending above said front insertion opening and adapted to limit upward movement of said at least one limiter block.

6. The multi-in-one card connector as claimed in claim 5, wherein the number of said at least one guide groove is 2, and the two guide grooves are respectively formed on the front side of each of said two upright sidewalls; the number of said at least one limiter block is 2, and the two limiter blocks are respectively accommodated in said two guide grooves; the shoulder of each of said two upright sidewalls each have a through hole in communication with the guide groove on the associating upright sidewall for receiving the top stop flange of the associating limiter block; said bottom panel has two locating grooves respectively disposed corresponding to said guide grooves for receiving the bottom stop flanges of said two limiter blocks respectively.

7. The multi-in-one card connector as claimed in claim 6, further comprising a top cover covered on said base frame over the shoulders of said upright sidewalls to stop said two limiter blocks in said two guide grooves.

8. The multi-in-one card connector as claimed in claim 7, wherein said bottom panel has an upright pin disposed in each of said locating grooves; the number of said at least one elastic member is 2, and the two elastic members are respectively sleeved onto the upright pins in said locating grooves and respectively stopped between said bottom panel and said two limiter blocks.

9. The multi-in-one card connector as claimed in claim 8, wherein said two limiter blocks each have an accommodation groove; said two elastic members are respectively accommodated in the accommodation grooves of said two limiter blocks.

10. The multi-in-one card connector as claimed in claim 2, wherein said two limiter blocks each have a stepped inner lateral side fitting the side edge configurations of different memory cards.

* * * * *